US011338600B2

(12) United States Patent
Honda

(10) Patent No.: US 11,338,600 B2
(45) Date of Patent: May 24, 2022

(54) RECORDING DEVICE AND RECORDING METHOD

(71) Applicant: SEIKO EPSON CORPORATION, Tokyo (JP)

(72) Inventor: Kenichi Honda, Matsukawa-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/775,406

(22) Filed: Jan. 29, 2020

(65) Prior Publication Data

US 2020/0247164 A1 Aug. 6, 2020

(30) Foreign Application Priority Data

Jan. 31, 2019 (JP) ..... JP2019-014960

(51) Int. Cl.
*B41J 29/393* (2006.01)
*B41J 2/045* (2006.01)

(52) U.S. Cl.
CPC ..... *B41J 29/393* (2013.01); *B41J 2/0451* (2013.01); *B41J 2/04558* (2013.01)

(58) Field of Classification Search
CPC ..... B41J 29/393
See application file for complete search history.

(56) References Cited

U.S. PATENT DOCUMENTS 6,443,554 B1 * 9/2002 Yoshida ..... B41J 2/15 347/41
2007/0008555 A1 * 1/2007 Hamamoto ..... G06K 15/102 358/1.8
2008/0079763 A1 * 4/2008 Abrott ..... B41J 29/393 347/19
2009/0225115 A1 * 9/2009 De Wall ..... B41J 2/2139 347/12

FOREIGN PATENT DOCUMENTS

JP 2004074510 A * 3/2004 ..... B41J 29/393
JP 2005-035102 A 2/2005

* cited by examiner

*Primary Examiner* — Shelby L Fidler
(74) *Attorney, Agent, or Firm* — Global IP Counselors, LLP

(57) ABSTRACT

A recording device includes a recording head in which a plurality of nozzle rows are arranged in a predetermined direction that include a first nozzle row including a plurality of nozzles for ejecting ink having a predetermined color, and a second nozzle row including a plurality of nozzles for ejecting ink having an identical color to the predetermined color, and a control unit configured to control ejection of ink by the nozzle, wherein the control unit, when a test pattern for an inspection of a missing dot due to an ejecting defect of the nozzle is recorded on a recording medium, records a dot pattern, that is an individual element that forms the test pattern, so that ink ejected from a nozzle of the first nozzle row, and ink ejected from a nozzle of the second nozzle row overlap.

6 Claims, 7 Drawing Sheets

RECORDING DEVICE AND RECORDING METHOD

The present application is based on, and claims priority from JP Application Serial Number 2019-014960, filed Jan. 31, 2019, the disclosure of which is hereby incorporated by reference herein in its entirety.

BACKGROUND

1. Technical Field

The present disclosure relates to a recording device and a recording method.

2. Related Art

While a large number of nozzles are provided in a recording head included in an ink jet printer, the nozzle may become clogged due to an increase in viscosity of ink or inclusion of air bubbles. When the nozzle become clogged, the printer does not actually eject ink, or does not eject a required amount of ink, even though the printer controls the ejection of the ink from the nozzle, and a defective recording point of a dot or a "missing dot" occurs in a recording result on a recording medium. The missing dot is problematic when obtaining good recording quality, so an inspection of the missing dot is required.

As the related art, a liquid ejecting device having a test pattern forming unit with which a test pattern is formed of a liquid ejected by a plurality of ejecting nozzles of a liquid ejecting head is disclosed (see JP-A-2005-35102).

When detecting a missing dot from test pattern recording results, the printer determined that continuation of recording is unsuitable and that processing to prevent reduction in recording quality due to clogging of the nozzle is required. Here, the "processing to prevent reduction in recording quality" refers to, for example, replacement of a recording head, cleaning of the recording head, and the like. However, in a case of a printer having a plurality of nozzle rows that eject ink of an identical color, even when some nozzles are clogged, there is a case that recording can be continued without problems. As such, although the printer can actually continue recording, there was a possibility that the printer determined from test pattern recording results that continuation of the recording was unsuitable.

What is needed is a mechanism to provide a test pattern that is suitable to prevent the determination from being made that continuation of recording is unsuitable when the recording can be actually continued.

SUMMARY

A recording device includes a recording head in which a plurality of nozzle rows are arranged in a predetermined direction that include a first nozzle row including a plurality of nozzles for ejecting ink having a predetermined color, and a second nozzle row including a plurality of nozzles for ejecting ink having an identical color to the predetermined color, and a control unit configured to control ejection of ink by the nozzle, wherein the control unit, when a test pattern for an inspection of a missing dot due to an ejecting defect of the nozzle is recorded on a recording medium, records a dot pattern, that is an individual element that forms the test pattern, so that ink ejected from a nozzle of the first nozzle row, and ink ejected from a nozzle of the second nozzle row overlap.

DESCRIPTION OF EXEMPLARY EMBODIMENTS

An exemplary embodiment of the present disclosure will be described below with reference to the accompanying drawings. The drawings are merely illustrative for describing the present exemplary embodiment. Because the drawings are illustrative, they are not consistent with each other, or some parts thereof are omitted in some cases.

1. General Description of Device

Figure 1:
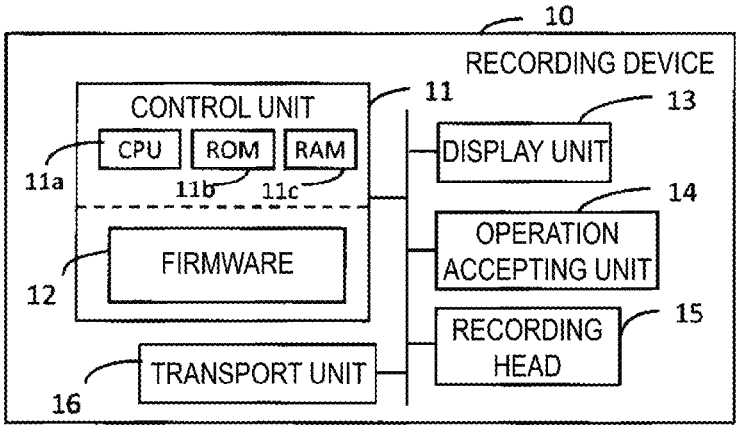
FIG. 1 is a block diagram simply illustrating a device configuration.

FIG. 1 simply illustrates a configuration of a recording device 10 according to the present exemplary embodiment. The recording device 10 may be described as a liquid ejecting device, a printing apparatus, a printer, or the like. The recording device 10 performs a recording method according to the present exemplary embodiment. The recording device 10 includes a control unit 11, a display unit 13, an operation accepting unit 14, a recording head 15, a transport unit 16, and the like. The control unit 11 is configured to include one or more ICs having a CPU 11*a* as a processor, a ROM 11*b*, a RAM 11*c*, and the like, and other non-volatile memory, and the like.

In the control unit 11, the processor or the CPU 11*a* controls the recording device 10, by performing arithmetic processing according to a program stored in the ROM 11*b*, other memory, or the like, using the RAM 11*c* or the like as a work area. The control unit 11 performs processing according to firmware 12, which is a type of program, for example. Note that, the processor is not limited to a single CPU, and may be configured to perform processing by a plurality of CPUs and a hardware circuit such as an Application Specific Integrated Circuit (ASIC), or may be configured such that a CPU and a hardware circuit cooperate to perform processing.

The display unit 13 is a unit for displaying visual information, and is configured by, for example, a liquid crystal display, an organic EL display, or the like. The display unit 13 may be configured to include a display and a driving circuit for driving the display. The operation accepting unit 14 is a unit for accepting an operation by a user, and is realized, for example, by a physical button, a touch panel, a keyboard, and the like. Of course, the touch panel may be realized as a function of the display unit 13. The display unit 13 and the operation accepting unit 14 can be collectively referred to as an operating panel of the recording device 10.

The transport unit 16 is a mechanism for transporting a recording medium. As is known, the transport unit 16 includes a roller for transporting the recording medium from upstream to downstream of a transport path, a motor for rotating the roller, and the like. The recording medium is typically paper, but may be a medium of a material other than paper as long as the medium is capable of recording by receiving ejected liquid.

Figure 2:
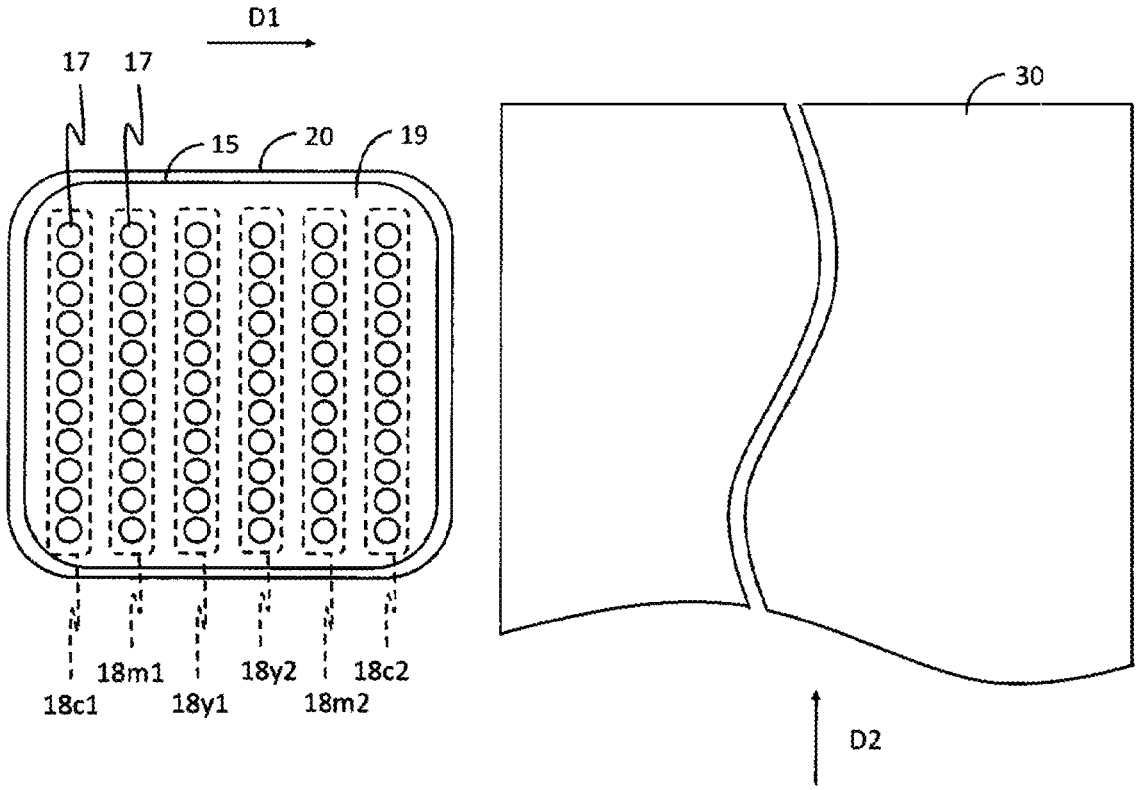
FIG. 2 is a diagram illustrating an example of an arrangement of nozzle rows included in a recording head.

The recording head 15 ejects ink by an ink-jet method and performs recording. As illustrated in FIG. 2, the recording head 15 includes a plurality of nozzles 17 capable of ejecting ink, and ejects the ink onto a recording medium 30 transported by the transport unit 16 from each of the nozzles 17. An ink droplet ejected by the nozzle 17 is referred to as a dot. However, in the following description, not only for the ink droplet ejected by the nozzle 17, but also in image processing by the control unit 11 before the ink droplet is ejected by the nozzle 17, representation of the dot is appropriately used. The control unit 11 controls application of a drive signal to a drive element (not illustrated) included in the nozzle 17 in accordance with print data, so as to suppress or perform ejection of the dot from the nozzles 17.

FIG. 2 illustrates an arrangement example of a plurality of nozzle rows included in the recording head 15. Additionally, FIG. 2 simply illustrates a relationship between the recording head 15 and the recording medium 30. The recording head 15 may be described as a liquid ejecting head, a printing head, a typing head, or the like. In the example in FIG. 2, the recording head 15 is mounted on a carriage 20 that is reciprocally movable along a predetermined direction D1, and moves with the carriage 20. In other words, although omitted in FIG. 1, according to the example in FIG. 2, the recording device 10 includes the carriage 20, and the control unit 11 also controls the movement of the carriage 20.

The direction D1 is also referred to as a main scanning direction D1. The transport unit 16 transports the recording medium 30 in a direction D2 that intersects with the direction D1. The direction D2 is also referred to as a sub scanning direction D2 or a transport direction D2. The intersection referred to here refers to orthogonal intersection, but may mean not only strict orthogonal intersection, but also intersection including an error of a degree that occurs due to actual part mounting accuracy, and the like.

A reference numeral 19 denotes a nozzle surface 19 in which the nozzle 17 in the recording head 15 opens. FIG. 2 illustrates an arrangement example of a plurality of nozzle rows on the nozzle surface 19. The recording head 15 is provided with a nozzle row for each ink color, in a configuration in which ink of each color is supplied from an ink retention unit (not illustrated) referred to as an ink cartridge, an ink tank, or the like mounted in the recording device 10, and the ink is ejected from the nozzle 17. The nozzle row is constituted by the plurality of nozzles 17 having a constant nozzle pitch, which is an interval along the direction D2 between the nozzles 17, and ejecting ink of an identical color. The recording head 15 ejects a plurality of ink colors such as cyan (C), magenta (M), yellow (Y), black (K), and the like.

In the example in FIG. 2, the recording head 15 includes a nozzle row 18*c*1 including the plurality of nozzles 17 for ejecting a C ink, a nozzle row 18*m*1 including the plurality of nozzles 17 for ejecting an M ink, and a nozzle row 18*y*1 including the plurality of nozzles 17 for ejecting a Y ink. Further, the recording head 15 includes a nozzle row 18*y*2 including the plurality of nozzles 17 for ejecting the Y ink, a nozzle row 18*m*2 including the plurality of nozzles 17 for ejecting the M ink, and a nozzle row 18*c*2 including the plurality of nozzles 17 for ejecting the C ink. As described above, the recording head 15 includes the plurality of nozzle rows that eject an identical color of ink.

Additionally, in the recording head 15, the plurality of nozzle rows are arranged along the direction D1. In the example illustrated in FIG. 2, respective positions of the nozzles 17 in the direction D2 are aligned with each other, for the nozzle rows 18*c*1, 18*m*1, 18*y*1, 18*y*2, 18*m*2, and 18*c*2 included in the recording head 15. However, "aligned" here may mean not only strict alignment but also alignment including an error of a degree that occurs due to actual formation accuracy of each of the nozzles 17, and the like.

When a nozzle row of a plurality of nozzle rows ejecting ink of a predetermined color is referred to as a "first nozzle row", another nozzle row of the plurality of nozzle rows ejecting the ink of the predetermined color is referred to as a "second nozzle row". In the example in FIG. 2, when one nozzle row of the nozzle rows 18*c*1 and 18*c*2 that eject the C ink as the predetermined color is referred to as the first nozzle row, another nozzle row is the second nozzle row. Similarly, when one nozzle row of the nozzle rows 18*m*1 and 18*m*2 that eject the M ink as the predetermined color is referred to as the first nozzle row, another nozzle row is the second nozzle row. Similarly, when one nozzle row of the nozzle rows 18*y*1 and 18*y*2 that eject the Y ink as the predetermined color is referred to as the first nozzle row, another nozzle row is the second nozzle row.

Of course, the number of nozzle rows included in the recording head 15 for each ink color may be three or more per one color instead of two per one color as illustrated in FIG. 2. In addition, although not illustrated in FIG. 2, the recording head 15 may have a configuration further including two or more number of nozzle rows including the plurality of nozzles 17 for ejecting a K ink.

According to the example in FIG. 2, the recording device 10 realizes recording on the recording medium 30, by alternately repeating the transport of a predetermined transport amount of the recording medium 30 by the transport unit 16, and the ink ejection by the recording head 15 along with the movement of the carriage 20. The ink ejection by the recording head 15 along with the movement of the carriage 20 is also referred to as scanning or passing.

The configuration described above may be realized not only by an independent single device, but also by an information processing device and a printer that are communicatively coupled to each other. The information processing device is, for example, a personal computer, a smart phone, a tablet terminal, a mobile phone, a server, or a device having an identical degree of processing capability as the aforementioned devices. In other words, the recording device 10 may be realized by an information processing device as a recording control device including the control unit 11 and the like, and a printer including the recording head 15, the carriage 20, the transport unit 16, and the like.

2. TP Recording Processing

Figure 3:
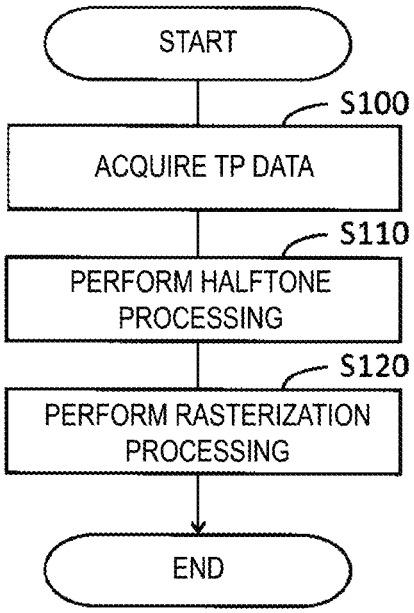
FIG. 3 is a flowchart illustrating TP recording processing.

FIG. 3 illustrates, by a flowchart, test pattern recording processing that the control unit 11 performs according to the firmware 12. The test pattern is abbreviated as "TP". A TP is an image for an inspection of a missing dot due to an ejecting defect of the nozzle 17. For example, when an operating mode of the recording device 10 is set to a TP recording mode for performing recording of the TP, the control unit 11 starts the TP recording processing. A user may select the TP recording mode as the operating mode of the recording device 10, by operating the operation accepting unit 14.

In step S100, the control unit 11 acquires TP data, which is image data representing a TP. The TP data is bitmap data in which each pixel has respective gradation values for ink colors such as CMY. The gradation value is represented by 256 gradations from 0 to 255, for example. The TP data is stored in advance in a storage medium such as a memory in and out of the recording device 10 accessible by the recording device 10, and the control unit 11 acquires the TP data from the storage destination of the TP data.

In step S110, the control unit 11 performs halftone processing on the TP data. A specific technique of the halftone processing is not particularly limited, and a dithering method, an error diffusion method, and the like can be employed. The halftone processing generates print data defining ejection (DOT-ON) or non-ejection (DOT-OFF) of a dot for each of the ink colors, such as the CMY, per pixel.

In step S120, the control unit 11 rearranges the print data generated from the TP data as described above in an order to be transferred to the recording head 15, and sequentially transfers the rearranged print data to the recording head 15 in a unit of predetermined amount of data. Step S120 is also referred to as rasterization processing. According to the rasterization processing, it is determined that a dot of each ink color defined by the print data is allocated to which of the nozzles 17 at what timing, in accordance with a pixel position and the ink color thereof. In the present exemplary embodiment, the control unit 11 performs the rasterization processing for a dot pattern, which is an individual element forming the TP, such that ink ejected from the nozzle 17 of the first nozzle row and ink ejected from the nozzle 17 of the second nozzle row are recorded in an overlapping manner. As a result of the rasterization processing, the recording head 15 performs recording of the TP on the recording medium 30 based on the transferred print data. "Such that ink ejected from the nozzle 17 of the first nozzle row and the ink ejected from the nozzle 17 of the second nozzle row are recorded in an overlapping manner" or "in an overlaying manner" means that control is performed in the recording device 10 so such that ink droplets overlap on the recording medium 30, and does not mean that it is guaranteed that the ink droplets are actually ejected and overlapping on the recording medium 30.

Figure 4:
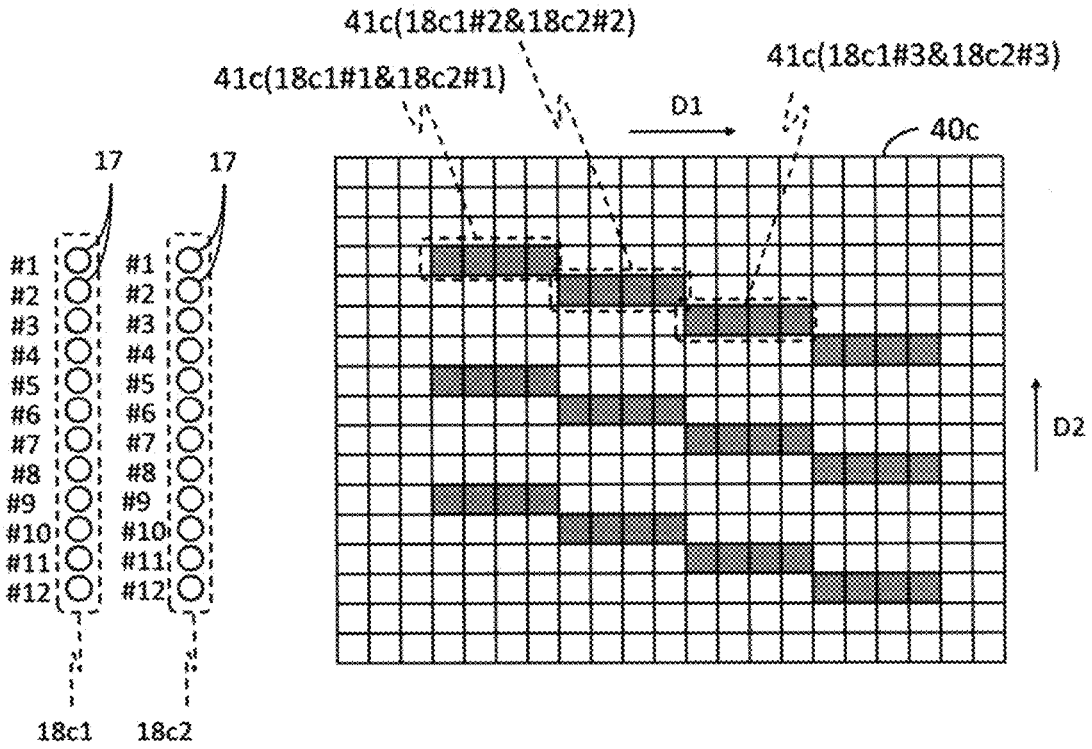
FIG. 4 is a diagram for explaining an example of allocation of nozzles and print data.

FIG. 4 is a diagram for explaining an example of the allocation of the nozzles 17 and the print data employed in the rasterization processing in step S120. A reference numeral 40*c* denotes a part of print data 40*c* defining DOT-ON or DOT-OFF of the C ink for each pixel, of the print data generated in step S110. An individual rectangle constituting the print data 40*c* represents each pixel. In FIG. 4, for ease of legend, a pixel for which DOT-ON is defined (DOT-ON pixel) is painted with a gray color, and a pixel for which DOT-OFF is defined (DOT-OFF pixel) is painted with a white color. In FIG. 4, a correspondence relationship between the print data 40*c*, the directions D1, and D2 is also illustrated.

According to FIG. 4, the print data 40*c* represents a TP in which a plurality of the dot patterns 41*c* formed by arranging a plurality of the DOT-ON pixels in a continuous manner parallel to the direction D1, are disposed while being displaced in the directions D1 and D2. That is, in the example in FIG. 4, one number of the dot pattern 41*c* is a straight line having a predetermined length (for example, corresponding to four dots) facing the direction D1. The TP represented by the print data 40*c* is, of course, a TP constituted by dot sequences of the C ink. Also, in FIG. 4, the nozzle rows 18*c*1 and 18*c*2 for ejecting the C ink are also illustrated on a left of the print data 40*c*. Each of the nozzle rows 18*c*1 and 18*c*2 records the print data 40*c* on the recording medium 30. In other words, the control unit 11 copies the print data 40*c* to allocate the identical print data 40*c* to each of the nozzle rows 18*c*1 and 18*c*2.

Here, the control unit 11 allocates the print data 40*c* to the nozzle 17 in a unit of pixel row including the dot pattern 41*c*. The pixel row is a region in which the pixels are arranged in a continuous manner parallel to the direction D1, and is also referred to as a raster line. In FIG. 4, for convenience of explanation, nozzle numbers #1, #2, #3, and so on are sequentially assigned to the respective nozzles 17 constituting the nozzle row from downstream to upstream in the transport direction D2, for each of the nozzle rows 18*c*1 and 18*c*2. The nozzles 17 with a common nozzle number are present at an identical positions in the direction D2. Accordingly, the control unit 11 allocates one pixel row including the dot pattern 41*c* to the nozzles 17 having identical positions in the direction D2 of the respective nozzle rows 18*c*1 and 18*c*2. According to the example in FIG. 4, the control unit 11 allocates a pixel row including the dot pattern 41*c* on top left to the nozzle 17 of the nozzle number #1 of the nozzle row 18*c*1 and the nozzle 17 of the nozzle number #1 of the nozzle row 18*c*2. In FIG. 4, for ease of legend, a nozzle row and a nozzle number of an allocation destination are noted in parentheses, along with a reference numeral "41*c*" of the dot pattern 41*c*.

A pixel row disposed upstream in the transport direction D2 adjacent to the pixel row allocated to the nozzle 17 of the nozzle number #1 of the nozzle row 18*c*1 and the nozzle 17 of the number #1 of the nozzle row 18*c*2, is allocated to the nozzle 17 of the nozzle number #2 of the nozzle row 18*c*1 and the nozzle 17 of the nozzle number #2 of the nozzle row 18*c*2. Similarly, a pixel row disposed upstream in the transport direction D2 adjacent to the pixel row allocated to the nozzle 17 of the nozzle number #2 of the nozzle row 18*c*1 and the nozzle 17 of the number #2 of the nozzle row 18*c*2, is allocated to the nozzle 17 of the nozzle number #3 of the nozzle row 18*c*1 and the nozzle 17 of the nozzle number #3 of the nozzle row 18*c*2. As a result of the above-described allocation, the TP formed from the plurality of dot patterns 41*c* illustrated in FIG. 4 is recorded on the recording medium 30 by ejection of the C ink from the nozzle row 18*c*2, and is recorded on the recording medium 30 by ejection of the C ink from the nozzle row 18*c*1. In other words, the ink ejected by the nozzle row 18*c*2, and the ink ejected by the nozzle row 18*c*1 overlap on the recording medium 30.

The control unit 11 performs allocation in a manner similar to the aspect in which the print data 40*c* for the C ink is allocated to the nozzle rows 18*c*1 and 18*c*2, for ink of other colors such as the M ink and the Y ink. In other words, the control unit 11 allocates identical print data to each of the nozzle rows 18*m*1 and 18*m*2 that ejects the M ink, by copying print data defining DOT-ON or DOT-OFF of the M ink for each pixel, of the print data generated in step S110. In addition, the control unit 11 allocates an identical print data to each of the nozzle rows 18*y*1 and 18*y*2 that ejects the Y ink, by copying print data defining DOT-ON or DOT-OFF of the Y ink for each pixel, of the print data generated in step S110.

Figure 5:
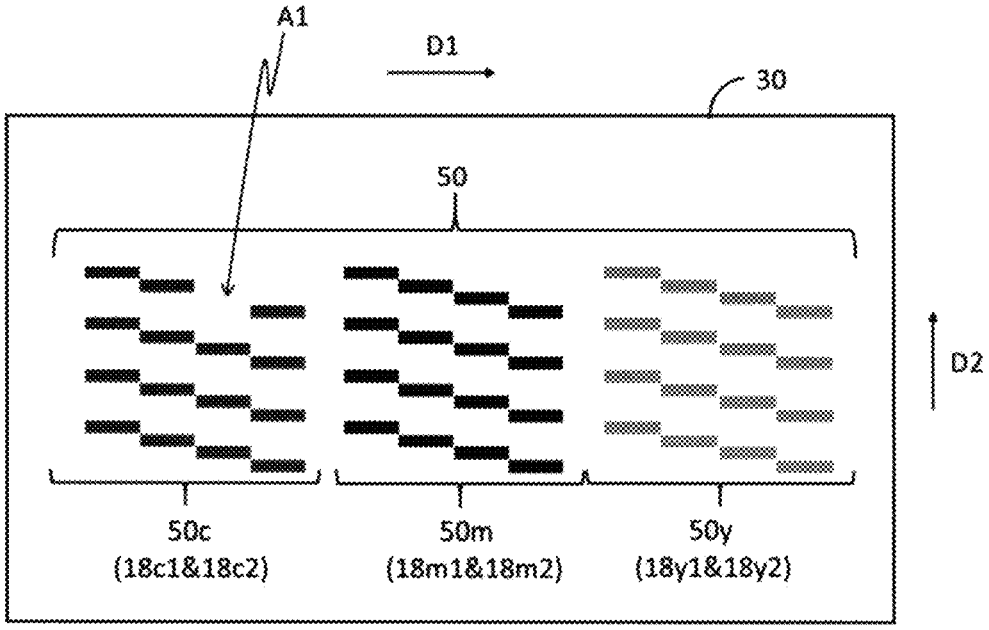
FIG. 5 is a diagram illustrating an example of a TP group recorded on a recording medium.

FIG. 5 illustrates an example of a TP group 50 recorded by the recording head 15 on the recording medium 30, as a result of the rasterization processing. In the example in FIG. 5, the TP group 50 including TPs 50*c*, 50*m*, and 50*y* is recorded on the recording medium 30. The TP 50*c* is a TP formed as a result of overlapping the C ink ejected by the nozzle 17 of the nozzle row 18*c*2, and the C ink ejected by the nozzle 17 of the nozzle row 18*c*1 on the recording medium 30. An individual straight line constituting the TP 50*c* is the dot pattern 41*c* described above. In FIG. 5, for ease of legend, along with reference numerals "50*c*", "50*m*", and "50*y*" of the respective TPs 50*c*, 50*m*, and 50*y*, the nozzle rows used for recording the respective TPs are noted in parentheses. Although colors and positions in the direction D1 of the respective TPs 50*c*, 50*m* and 50*y* are different from each other, shapes thereof are identical.

The TP 50*m* is a TP formed as a result of overlapping the M ink ejected by the nozzle 17 of the nozzle row 18*m*2, and the M ink ejected by the nozzle 17 of the nozzle row 18*m*1 on the recording medium 30. An individual straight line constituting the TP 50*m* is a dot pattern. The TP 50*y* is a TP formed as a result of overlapping the Y ink ejected by the nozzle 17 of the nozzle row 18*y*2, and the Y ink ejected by the nozzle 17 of the nozzle row 18*y*1 on the recording medium 30. An individual straight line constituting the TP 50*y* is a dot pattern.

In the example in FIG. 5, the TPs 50*c*, 50*m*, and 50*y* are disposed along a longitudinal direction of the straight line as the dot pattern. Accordingly, the control unit 11 can record the TP group 50 on the recording medium 30, in a single pass of the carriage 20 on which the recording head 15 is mounted. The TP data acquired in step S100 is image data representing the TP group 50 described above.

As can be seen from the previous description, the individual dot patterns are recorded using the plurality of nozzles 17 that have the identical positions in the direction D2 and eject the ink of the identical color. Thus, when at least one of the nozzles 17 used in recording of a dot pattern can eject ink normally, the dot pattern is recorded on the recording medium 30. On the other hand, when all of the nozzles 17 used in recording of a dot pattern are clogged or defective, the dot pattern is not recorded on the recording medium 30. At a position indicated by an arrow A1 in FIG. 5, a straight line as the dot pattern 41*c* with the C ink is to be recorded, but is not recorded (a missing dot is generated). This means that both two number of the nozzles 17 used in recording of the dot pattern to be recorded at that position each have an ejecting defect.

The plurality of nozzles 17 that have a relationship to record one dot pattern together, and eject ink of identical color can complement ejecting defects mutually. That is, normal recording can be continued, when one of the plurality of nozzles 17 that have the relationship to record the one dot pattern together, and eject the ink of the identical color does not have an ejecting defect. In recording of a TP by the related art, separate patterns were recorded by respective nozzles of each nozzle row, and when occurrence of clogging is observed in some nozzles, even when the ejecting defects of the some nozzles can be complemented by another nozzle, it was determined that continuation of the recording is unsuitable in some cases. Accordingly, the determination indicating the unsuitableness is likely to occur frequently, and there has been a possibility that work efficiency of a user who wishes to perform printing of an arbitrarily selected document, photo, or the like is reduced. Compared to this, by using the TP recorded in the present exemplary embodiment for evaluation of a missing dot, it is possible to appropriately determine whether a missing dot that makes the recording impossible, in other words, a missing dot that is indicated by the arrow A1 and cannot be resolved with the complement by the nozzles, is generated, or not.

Accordingly, the reduction in work efficiency as described above can be avoided. Note that, an inspection for a TP recorded on the recording medium 30 may be a visual inspection by the user, or may be an inspection automatically performed by the recording device 10 or the like that is inputted with colorimetric results of the TP according to a program.

3. Second Exemplary Embodiment

The exemplary embodiment described above is referred to as a first exemplary embodiment for convenience.

Next, a second exemplary embodiment will be described. For the following exemplary embodiments, which include the second exemplary embodiment, different matters from those of the first exemplary embodiment will be described, while taking over the description of the first exemplary embodiment.

Figure 6:
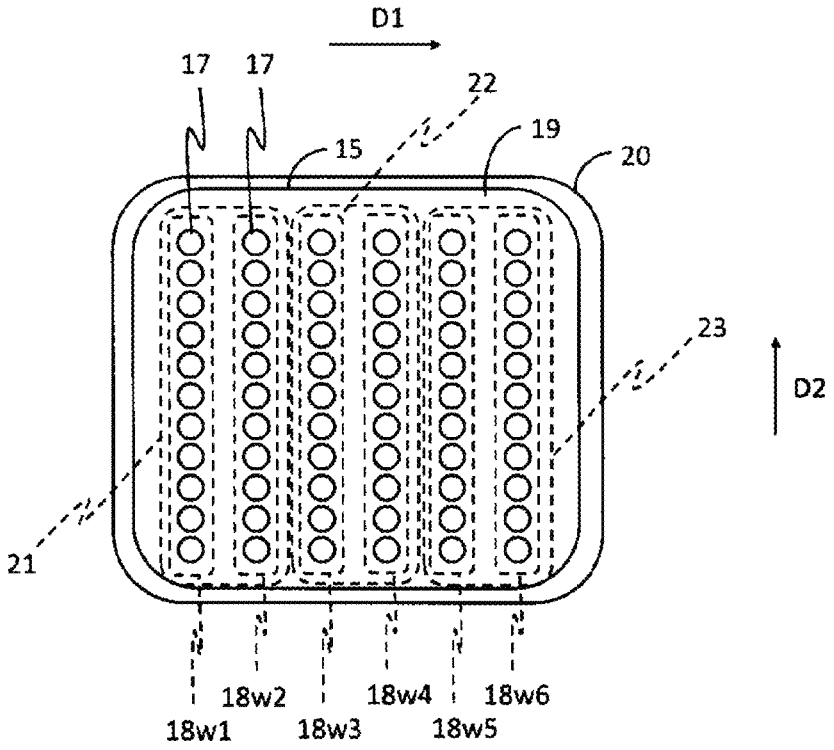
FIG. 6 is a diagram illustrating another example of the arrangement of the nozzle rows included in the recording head.

FIG. 6 illustrates an arrangement example of a plurality of nozzle rows included in the recording head 15. A way of viewing FIG. 6 is similar to that for FIG. 2. In FIG. 6, illustration of the recording medium 30 is omitted. A plurality of nozzle rows 18*w*1, 18*w*2, 18*w*3, 18*w*4, 18*w*5, and 18*w*6 illustrated in FIG. 6 all eject a so-called white (W) ink from each of the nozzles 17. Positions of the respective nozzles 17 in the direction D2 are aligned, for the nozzle rows 18*w*1, 18*w*2, 18*w*3, 18*w*4, 18*w*5, and 18*w*6 included in the recording head 15. In the example in FIG. 6, when one nozzle row of the nozzle rows 18*w*1, 18*w*2, 18*w*3, 18*w*4, 18*w*5, and 18*w*6 for ejecting the W ink is referred to as a first nozzle row, one nozzle row other than the aforementioned one nozzle row is a second nozzle row.

The recording head 15 may be configured to include a plurality of head chips. A plurality of nozzle rows are formed in the head chip. In the example in FIG. 6, the recording head 15 includes head chips 21, 22, and 23. The head chips 21, 22, and 23 are aligned along the direction D1, and two rows of nozzle rows are formed in each of the head chips. The nozzle row 18*w*1 and the nozzle row 18*w*2 are formed in the head chip 21. The nozzle row 18*w*3 and the nozzle row 18*w*4 are formed in the head chip 22. The nozzle row 18*w*5 and the nozzle row 18*w*6 are formed in the head chip 23.

Of course, in the example in FIG. 2, the recording head 15 may be configured such that a plurality of head chips each having a plurality of nozzle rows are arranged. For example, the nozzle row 18*c*1 and the nozzle row 18*m*1 may be formed in a common head chip, the nozzle row 18*y*1 and the nozzle row 18*y*2 may be formed in a common head chip, and the nozzle row 18*m*2 and nozzle row 18*c*2 may be formed in a common head chip.

Even in a configuration in which the recording head 15 includes the plurality of nozzle rows 18*w*1, 18*w*2, 18*w*3, 18*w*4, 18*w*5, and 18*w*6, the control unit 11 performs the TP recording processing (FIG. 3), and records a TP on the recording medium 30 by the recording head 15. In the second exemplary embodiment, the recording medium 30 used by the recording device 10 for recording the TP is a medium having a color other than white or a medium such as a transparent film.

Figure 7:
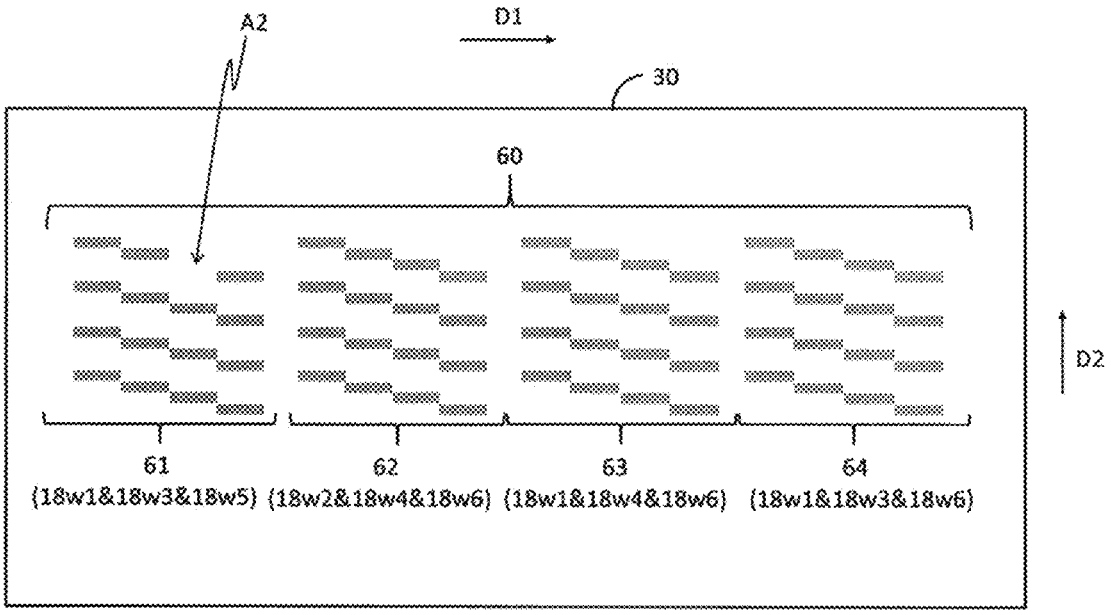
FIG. 7 is a diagram illustrating another example of the TP group recorded on the recording medium.

FIG. 7 illustrates an example of a TP group 60 recorded by the recording head 15 on the recording medium 30, as a result of rasterization processing in the second exemplary embodiment. In the example in FIG. 7, the TP group 60 including TPs 61, 62, 63, and 64 is recorded on the recording medium 30. In the second exemplary embodiment, TP data acquired by the control unit 11 in step S100 is image data representing the above-described TP group 60.

For example, the TP 61 is a TP formed as a result of overlapping the W ink ejected by the nozzle 17 of the nozzle row 18$w$1, and the W ink ejected by the nozzle 17 of the nozzle row 18$w$3, and the W ink ejected by the nozzle 17 of the nozzle row 18$w$5 on the recording medium 30. An individual line constituting the TP 61 is a dot pattern. With respect to the recording of the TP 61, two nozzle rows of the nozzle rows 18$w$1, 18$w$3, and 18$w$5 correspond to the first nozzle row and the second nozzle row respectively.

Individual lines (dot patterns) constituting the TP 61, 62, 63, and 64 are actually recorded with the W ink, but in FIG. 7, the dot patterns are illustrated in gray for these dot patterns to be visually recognizable. In addition, in FIG. 7, for ease of legend, along with reference numerals "61", "62", "63", and "64" of the respective TPs 61, 62, 63, and 64, the nozzle rows used for recording each of the TPs are noted in parentheses. In other words, for the recording of the TP 61, the control unit 11 copies data corresponding to a portion of the TP 61 of the print data generated from the TP data in step S110, and allocates the data to each of the nozzle rows 18$w$1, 18$w$3, and 18$w$5. As a result of such allocation, the TP 61 consisting of the plurality of dot patterns illustrated in FIG. 7 is recorded on the recording medium 30 by ejection of the W ink from the nozzle row 18$w$5, is recorded on the recording medium 30 by ejection of the W ink from the nozzle row 18$w$3, and is further recorded on the recording medium 30 by ejection of the W ink from the nozzle row 18$w$1. Positions of the respective TPs 61, 62, 63, and 64 in the direction D1 are different from each other, but colors and shapes thereof are identical. Additionally, the shape of the TPs (TP 50$c$, 50$m$, and 50$y$) of the first exemplary embodiment and the shape of the TPs (TP 61, 62, 63, and 64) of the second exemplary embodiment are identical.

Similarly, the TP 62 is a TP formed as a result of overlapping the W ink ejected by the nozzle 17 of the nozzle row 18$w$2, the W ink ejected by the nozzle 17 of the nozzle row 18$w$4, and the W ink ejected by the nozzle 17 of the nozzle row 18$w$6 on the recording medium 30. With respect to the recording of the TP 62, two nozzle rows of the nozzle rows 18$w$2, 18$w$4, and 18$w$6 correspond to the first nozzle row and the second nozzle row respectively.

Similarly, the TP 63 is a TP formed as a result of overlapping the W ink ejected by the nozzle 17 of the nozzle row 18$w$1, the W ink ejected by the nozzle 17 of the nozzle row 18$w$4, and the W ink ejected by the nozzle 17 of the nozzle row 18$w$6 on the recording medium 30. With respect to the recording of the TP 63, two nozzle rows of the nozzle rows 18$w$1, 18$w$4, and 18$w$6 correspond to the first nozzle row and the second nozzle row respectively.

Similarly, the TP 64 is a TP formed as a result of overlapping the W ink ejected by the nozzle 17 of the nozzle row 18$w$1, the W ink ejected by the nozzle 17 of the nozzle row 18$w$3, and the W ink ejected by the nozzle 17 of the nozzle row 18$w$6 on the recording medium 30. With respect to the recording of the TP 64, two nozzle rows of the nozzle rows 18$w$1, 18$w$3, and 18$w$6 correspond to the first nozzle row and the second nozzle row respectively.

In the example in FIG. 7, the TPs 61, 62, 63, and 64 are disposed along a longitudinal direction of the straight line as the dot pattern. Accordingly, the control unit 11 can record the TP group 60 on the recording medium 30 in a single pass of the carriage 20 on which the recording head 15 is mounted.

Also in the second exemplary embodiment, the individual dot patterns are recorded using the plurality of nozzles 17 for which positions in the direction D2 are identical and that eject ink of identical color. At a position indicated by an arrow A2 in FIG. 7, a straight line as the dot pattern with the W ink is to be recorded, but is not recorded (a missing dot is generated). This means that all three number of the nozzles 17 used in recording of the dot pattern to be recorded at that position each have an ejecting defect.

When compared with ink of other colors such as ink of the CMY, the W ink is likely to clog the nozzle 17 due to characteristics of particles contained and the like. Thus, in a configuration in which a nozzle row that ejects the W ink that is likely to clog a nozzle is included, determination that continuation of recording is unsuitable is more frequently made, based on recording results of a TP in the past, and there was a possibility in particular that operating efficiency for a user is reduced. Compared to this, according to the second exemplary embodiment, the reduction in the operation efficiency can be avoided, by recording a TP for which whether or not a missing dot that prevents recording from being continued occurs is easy to determine.

Note that, the TPs included in the TP group 60 are not limited to the TPs 61, 62, 63, and 64. The control unit 11, when recording one TP formed of a plurality of dot patterns so that the dot patterns overlap using three nozzle rows as described above, may record TPs on the recording medium 30, such that the TPs correspond to all combination of three nozzle rows from among the nozzle rows 18$w$1, 18$w$2, 18$w$3, 18$w$4, 18$w$5, and 18$w$6. Furthermore, an aspect in which one TP formed of a plurality of dot patterns is recorded so that the dot patterns overlap using three nozzle rows corresponding to ink of an identical color is also merely a part of the present exemplary embodiment. The control unit 11 may record one TP formed of a plurality of dot patterns so that the dot patterns overlap using two nozzle rows corresponding to an identical color as in the first exemplary embodiment, for example, or may record so that the dot patterns overlap using four or more nozzle rows corresponding to an identical color.

4. Summary

As described above, according to the present exemplary embodiment, the recording device 10 includes the recording head 15 in which a plurality of nozzle rows including a first nozzle row including a plurality of the nozzles 17 for ejecting ink having a predetermined color, and a second nozzle row including a plurality of the nozzles 17 for ejecting ink having an identical color to the predetermined color are arranged in a predetermined direction (the direction D1), and the control unit 11 for controlling the ejection of the ink by the nozzle 17. Then, when a TP for an inspection of a missing dot due to an ejecting defect of the nozzle 17 is recorded on the recording medium 30, the control unit 11 records a dot pattern, which is an individual element that forms the TP, so that ink ejected from the nozzle 17 of the first nozzle row and ink ejected from the nozzle 17 of the second nozzle row overlap.

According to the configuration, the dot pattern is recorded when one or more number of the nozzles 17 of the plurality of nozzles 17 used in recording of the dot pattern do not have an ejecting defect. Accordingly, it is possible to provide a TP suitable for preventing determination that continuation of recording is unsuitable from being made, despite normal recording is possible with complement by the nozzle 17 that does not have an ejecting defect.

Further, as one of the present exemplary embodiments, the control unit 11 records a dot pattern so that ink ejected from the nozzle 17 of a first nozzle row, and ink ejected from the nozzle 17 of a second nozzle row not corresponding to a nozzle row adjacent to the first nozzle row in a predetermined direction (the direction D1) overlap. For example, according to FIGS. 6 and 7, each dot pattern constituting the TPs 61, 62, 63, and 64 is recorded using a combination of nozzle rows that are not adjacent to each other. For the nozzles 17 with a close distance, presence or absence or a degree of clogging is likely to be similar, because, for example, results and trends of wiping by a wiper that removes foreign particles from a nozzle opening are similar, and the like. As such, the control unit 11 records a common dot pattern by using the plurality of nozzles 17 belonging to each of the plurality of nozzle rows having a positional relationship that the nozzle rows are not adjacent to each other. This makes it easier to record the dot pattern by the complement of the ejecting defects of some of the nozzles 17 using other nozzles 17 for an identical color.

In addition, as one of the present exemplary embodiments, the recording head 15 has a configuration in which a plurality of head chips, in each of which a plurality of nozzle rows are arranged in the direction D1, are arranged in the direction D1. Then, the control unit 11 records a dot pattern so that ink ejected from the nozzle 17 of a first nozzle row, and ink ejected from the nozzle 17 of a second nozzle row included in a head chip that is different from a head chip including the first nozzle row overlap. For example, according to FIGS. 6 and 7, each dot pattern constituting the TPs 61, 62, 63, and 64 is recorded using a combination of nozzle rows belonging to different head chips respectively. Because the nozzles 17 in a common nozzle chip are manufactured simultaneously, characteristics including ease of clogging tend to be similar among the nozzles 17. As such, the control unit 11 records a common dot pattern by using the plurality of nozzles 17 belonging to each of the plurality of nozzle rows having a relationship that the nozzle rows belong to the different head chips respectively. This makes it easier to record the dot pattern by the complement of the ejecting defects of some of the nozzles 17 using other nozzles 17 for an identical color.

In addition, according to the present exemplary embodiment, the control unit 11 records the dot pattern such that ink droplets overlap that are ejected from the respective nozzles 17 being the nozzle 17 of the first nozzle row and the nozzle 17 of the second nozzle row, and having identical positions in the direction D2 orthogonal to the direction D1.

According to the configuration, the dot pattern can be recorded by the plurality of nozzles 17 having a relationship that the nozzles 17 are capable of mutually complementing a missing dot.

Furthermore, the present exemplary embodiment discloses a recording method for controlling the recording head 15 in which a plurality of nozzle rows are arranged in a predetermined direction (the direction D1) to perform recording. That is, according to the recording method, a plurality of nozzle rows include a first nozzle row including a plurality of the nozzles 17 for ejecting ink having a predetermined color, and a second nozzle row including a plurality of the nozzles 17 for ejecting ink having an identical color to the predetermined color, and when a TP for an inspection of a missing dot due to an ejecting defect of the nozzles 17 is recorded on the recording medium 30, a dot pattern, which is an individual element that forms the TP, is recorded so that ink ejected from the nozzle 17 of the first nozzle row and ink ejected from the nozzle 17 of the second nozzle row overlap.

5. Other Exemplary Embodiments

The present exemplary embodiment further includes various aspects as described below.

Respective positions in the direction D2 of a plurality of nozzle rows included in the recording head 15 may be displaced from each other. For example, in the configuration illustrated in FIG. 2, for a set of the nozzle rows 18*c*1, 18*y*1, and 18*m*2 disposed on every other row, and a set of the remaining nozzle rows 18*m*1, 18*y*2, and 18*c*2 disposed on every other row, positions in the direction D2 may be displaced from each other by a distance of half a nozzle pitch. More specifically, with respect to the set of nozzle rows 18*c*1, 18*y*1, and 18*m*2 disposed on every other row, the set of remaining nozzle rows 18*m*1, 18*y*2, and 18*c*2 is disposed upstream in the direction D2, while being displaced by a distance of half the nozzle pitch. In this manner, in a case of the configuration in which the set of nozzle rows 18*c*1, 18*y*1, and 18*m*2 disposed on every other row, and the set of remaining nozzle rows 18*m*1, 18*y*2, and 18*c*2 disposed on every other row are disposed while being displaced from each other in the direction D2, the control unit 11 records the TP group 50 (FIG. 5) on the recording medium 30 by two passes of the recording head 15. For example, the control unit 11 ejects ink from the nozzle rows 18*c*1, 18*y*1, and 18*m*2 in a first pass of the recording head 15. Then, after the first pass, the recording medium 30 is transported by the transport unit 16 by a distance of half the nozzle pitch, and subsequently, the ink is ejected from the nozzle rows 18*m*1, 18*y*2, and 18*c*2 in a second pass of the recording head 15. Accordingly, the TP group 50 including the TPs 50*c*, 50*m*, and 50*y* is recorded on the recording medium 30.

The recording device 10 may include the recording head 15 (a first recording head) having the plurality of nozzle rows 18*w*1, 18*w*2, 18*w*3, 18*w*4, 18*w*5, and 18*w*6 illustrated in FIG. 6, and the recording head 15 (a second recording head) having the plurality of nozzle rows 18*c*1, 18*m*1, 18*y*1, 18*y*2, 18*m*2, and 18*c*2 illustrated in FIG. 2. In other words, the first recording head and the second recording head are mounted on the carriage 20. In this case, in the carriage 20, the first recording head is disposed upstream in the direction D2 with respect to the second recording head. According to such a configuration, the control unit 11 causes the carriage 20 to scan in the direction D1 with respect to the recording medium 30 transported from upstream to downstream in the direction D2 by the transport unit 16, causes the W ink to be ejected from the first recording head to record the TP group 60, and causes ink of colors such as the CMY to be ejected from the second recording head to record the TP group 50.

The recording head 15 may be a line head elongated in the direction D1. In other words, the recording head 15 is fixed in the recording device 10 in an orientation rotated 90° from the state illustrated in FIG. 2 and FIG. 6. When the recording head 15 is a line head, the carriage 20 is not needed. In a line head, each nozzle row is constituted by a plurality of the nozzles 17 with a constant nozzle pitch along the direction D1. Further, each of the nozzle rows has a length that spans a range corresponding to a width in the direction D1 of the recording medium 30 transported in the direction D2, and ejects ink onto the recording medium 30 transported. Also, in a configuration where the recording head 15 is a line head, a TP is recorded on the recording medium 30 not in an orientation in which a longitudinal direction of a dot pattern as an individual straight line is parallel to the direction D1 as illustrated in FIGS. 5 and 7, but in an orientation parallel to the direction D2.

What is claimed is:

1. A recording device comprising:

a recording head in which a plurality of nozzle rows are arranged in a predetermined direction that include a first nozzle row including a plurality of nozzles for ejecting ink having a predetermined color, and a second nozzle row including a plurality of nozzles for ejecting ink having an identical color to the predetermined color; and a control unit configured to control ejection of ink by the nozzles, wherein the control unit, when a test pattern for an inspection of a missing dot due to an ejecting defect of the nozzles is recorded on a recording medium, records one dot pattern of dot patterns, each of which is an individual element that forms the test pattern, by controlling ejection of ink dots from a nozzle of the first nozzle row, and ejection of ink dots from a nozzle of the second nozzle row so that each of all of the ink dots that are ejected from the nozzle of the first nozzle row and form the one dot pattern overlaps each of all of the ink dots that are ejected from the nozzle of the second nozzle row and form the one dot pattern, wherein the control unit records the one dot pattern so that each of the all of the ink dots ejected from the nozzle of the first nozzle row to form the one dot pattern, and each of the all of the ink dots ejected to form the one dot pattern from the nozzle of the second nozzle row not corresponding to a nozzle row adjacent to the first nozzle row in the predetermined direction overlap.

2. The recording device according to claim 1, wherein when the one dot pattern of the test pattern is recorded on the recording medium, the control unit generates print data defining ejection or non-ejection of a dot of the ink per pixel for the one dot pattern, copies the print data, allocates generated print data that has been generated and copied print data that has been copied to the nozzle of the first nozzle row and the nozzle of the second nozzle row, and records the one dot pattern based on the generated print data and the copied print data so that each of the all of the ink dots ejected from the nozzle of the first nozzle row to form the one dot pattern overlaps each of the all of the ink dots ejected from the nozzle of the second nozzle row to form the one dot pattern.

3. A recording device comprising:

a recording head in which a plurality of nozzle rows are arranged in a predetermined direction that include a first nozzle row including a plurality of nozzles for ejecting ink having a predetermined color, and a second nozzle row including a plurality of nozzles for ejecting ink having an identical color to the predetermined color; and a control unit configured to control ejection of ink by the nozzles, wherein the control unit, when a test pattern for an inspection of a missing dot due to an ejecting defect of the nozzles is recorded on a recording medium, records one dot pattern of dot patterns, each of which is an individual element that forms the test pattern, by controlling ejection of ink dots from a nozzle of the first nozzle row, and ejection of ink dots from a nozzle of the second nozzle row so that each of all of the ink dots that are ejected from the nozzle of the first nozzle row and form the one dot pattern overlaps each of all of the ink dots that are ejected from the nozzle of the second nozzle row and form the one dot pattern, wherein the recording head has a configuration in which a plurality of head chips, in which a plurality of nozzle rows are arranged in the predetermined direction, are arranged in the predetermined direction, and the control unit records the one dot pattern so that each of the all of the ink dots ejected from the nozzle of the first nozzle row to form the one dot pattern, and each of the all of the ink dots ejected to form the one dot pattern from the nozzle of the second nozzle row included in the head chip that is different from the head chip including the first nozzle row overlap.

4. The recording device according to claim 3, wherein when the one dot pattern of the test pattern is recorded on the recording medium, the control unit generates print data defining ejection or non-ejection of a dot of the ink per pixel for the one dot pattern, copies the print data, allocates generated print data that has been generated and copied print data that has been copied to the nozzle of the first nozzle row and the nozzle of the second nozzle row, and records the one dot pattern based on the generated print data and the copied print data so that each of the all of the ink dots ejected from the nozzle of the first nozzle row to form the one dot pattern overlaps each of the all of the ink dots ejected from the nozzle of the second nozzle row to form the one dot pattern.

5. A recording device comprising:

a recording head in which a plurality of nozzle rows are arranged in a predetermined direction that include a first nozzle row including a plurality of nozzles for ejecting ink having a predetermined color, and a second nozzle row including a plurality of nozzles for ejecting ink having an identical color to the predetermined color; and a control unit configured to control ejection of ink by the nozzles, wherein the control unit, when a test pattern for an inspection of a missing dot due to an ejecting defect of the nozzles is recorded on a recording medium, records one dot pattern of dot patterns, each of which is an individual element that forms the test pattern, by controlling ejection of ink dots from a nozzle of the first nozzle row, and ejection of ink dots from a nozzle of the second nozzle row so that each of all of the ink dots that are ejected from the nozzle of the first nozzle row and form the one dot pattern overlaps each of all of the ink dots that are ejected from the nozzle of the second nozzle row and form the one dot pattern, wherein the control unit records the one dot pattern such that each of the all of the ink dots ejected from the nozzle of the first nozzle row to form the one dot pattern and each of the all of the ink dots ejected from the nozzle of the second nozzle to form the one dot pattern overlap, with the nozzle of the first nozzle row and the nozzle of the second nozzle being at an identical position in a direction orthogonal to the predetermined direction.

6. The recording device according to claim 5, wherein when the one dot pattern of the test pattern is recorded on the recording medium, the control unit generates print data defining ejection or non-ejection of a dot of the ink per pixel for the one dot pattern, copies the print data, allocates generated print data that has been generated and copied print data that has been copied to the nozzle of the first nozzle row and the nozzle of the second nozzle row, and records the one dot pattern based on the generated print data and the copied print data so that each of the all of the ink dots ejected from the nozzle of the first nozzle row to form the one dot pattern overlaps each of the all of the ink dots ejected from the nozzle of the second nozzle row to form the one dot pattern.

* * * * *